US010942483B2

(12) United States Patent
Watanabe

(10) Patent No.: US 10,942,483 B2
(45) Date of Patent: Mar. 9, 2021

(54) IMAGE FORMING APPARATUS

(71) Applicant: CANON KABUSHIKI KAISHA, Tokyo (JP)

(72) Inventor: Koichi Watanabe, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/176,916

(22) Filed: Jun. 8, 2016

(65) Prior Publication Data

US 2016/0363904 A1 Dec. 15, 2016

(30) Foreign Application Priority Data

Jun. 11, 2015 (JP) ..... JP2015-118575

(51) Int. Cl.
*G03G 15/00* (2006.01)
*G03G 21/16* (2006.01)
(Continued)

(52) U.S. Cl.
CPC ..... *G03G 21/1628* (2013.01); *B65H 29/125* (2013.01); *B65H 31/02* (2013.01); *G03G 15/6552* (2013.01); *G03G 21/1695* (2013.01); *B65H 2220/04* (2013.01); *B65H 2301/4212* (2013.01); *B65H 2402/10* (2013.01); *B65H 2402/31* (2013.01); *B65H 2404/6111* (2013.01); *B65H 2511/20* (2013.01); *B65H 2511/214* (2013.01); *B65H 2511/528* (2013.01); *B65H 2601/11* (2013.01); *B65H 2801/27* (2013.01);
(Continued)

(58) Field of Classification Search
CPC ..... G03G 15/6552; G03G 21/1695; G03G 21/1628; G03G 2215/0054; B65H 29/125; B65H 31/02; B65H 2601/11; B65H 2402/10; B65H 2511/20; B65H 2301/4212; B65H 2801/27; B65H 2511/214; B65H 2404/6111; B65H 2220/04; B65H 2402/31
See application file for complete search history.

(56) References Cited

U.S. PATENT DOCUMENTS 8,454,014 B2 * 6/2013 Kotera ..... B65H 5/062 271/272
2017/0036877 A1 * 2/2017 Izumichi ..... B65H 29/52

FOREIGN PATENT DOCUMENTS

JP 05-323727 * 12/1993 ..... G03G 15/00
JP 08-143054 * 6/1996 ..... G03G 15/00
(Continued)

*Primary Examiner* — Matthew G Marini
*Assistant Examiner* — Marissa Ferguson-Samreth
(74) *Attorney, Agent, or Firm* — Canon U.S.A., Inc. I.P. Division

(57) ABSTRACT

An image forming apparatus includes, a main body of the image forming apparatus configured to form an image on a sheet, and provided with a stacking portion on which a sheet with an image formed thereon is stacked, a sheet conveyance device detachably attached to the stacking portion of the main body of the image forming apparatus, and provided with a conveyance path for conveying a sheet, a guide portion disposed in the sheet conveyance device, and configured to guide the conveyed sheet, a vertically extending wall portion disposed in the main body of the image forming apparatus, facing the stacking portion, and a restriction portion protruded from the wall portion, and configured to restrict a movement of the guide portion in a direction for opening the conveyance path.

22 Claims, 13 Drawing Sheets

(51) Int. Cl.
*B65H 29/12* (2006.01)
*B65H 31/02* (2006.01)

(52) U.S. Cl.
CPC ..... *G03G 2215/0054* (2013.01); *G03G 2215/00544* (2013.01)

(56) References Cited

FOREIGN PATENT DOCUMENTS

| | | | | |
|---|---|---|---|---|
| JP | 10-252740 | * | 9/1998 | ..... G03G 15/00 |
| JP | 2000-327170 | * | 11/2000 | ..... B65H 5/06 |
| JP | 2011-195275 | * | 10/2011 | ..... G03G 15/00 |
| JP | 2011195277 A | | 10/2011 | |

* cited by examiner

IMAGE FORMING APPARATUS

BACKGROUND OF THE INVENTION

Field of the Invention

The present invention relates to an image forming apparatus for forming an image on a sheet.

Description of the Related Art

The main body of an image forming apparatus is provided with a stacking portion on which sheets with an image formed thereon are stacked. A relay conveyance device for conveying a sheet to a sheet post-processing apparatus is attached to the stacking portion of the main body of the image forming apparatus (refer to Japanese Patent Application Laid-Open No. 2011-195277). In the relay conveyance device, an upper guide member is rotatably supported. A user opens the upper guide member and removes a sheet jammed in the relay conveyance path.

In a case where an image reading unit is disposed at the upper part of the relay conveyance device when the relay conveyance device is attached to the main body of the image forming apparatus as discussed in Japanese Patent Application Laid-Open No. 2011-195277, the upper guide member abuts to the undersurface of the image reading unit, and the rotation of the upper guide member is restricted. On the other hand, in a case where an image reading unit is not disposed at the upper part of the relay conveyance device and the upper part of the relay conveyance device becomes an open space when the relay conveyance device is attached to the main body of the image forming apparatus, the following problems may possibly arise. More specifically, the upper guide member opens too largely because there is no member for restricting the rotation of the upper guide member. When the upper guide member stops at a largely opened position, the user finds it difficult to close the upper guide member, and the operability is degraded. In particular, a short user will find it difficult to close the upper guide member in a largely opened state.

SUMMARY OF THE INVENTION

According to an aspect of the present invention, an image forming apparatus includes, a main body of the image forming apparatus configured to form an image on a sheet, and provided with a stacking portion on which a sheet with an image formed thereon is stacked, a sheet conveyance device detachably attached to the stacking portion of the main body of the image forming apparatus, and provided with a conveyance path for conveying a sheet, a guide portion disposed in the sheet conveyance device, and configured to guide the conveyed sheet, a vertically extending wall portion disposed in the main body of the image forming apparatus, facing the stacking portion, and a restriction portion protruded from the wall portion, and configured to restrict a movement of the guide portion in a direction for opening the conveyance path.

Further features of the present invention will become apparent from the following description of exemplary embodiments with reference to the attached drawings.

DESCRIPTION OF THE EMBODIMENTS

An image forming apparatus according to an exemplary embodiment of the present invention will be described below with reference to the accompanying drawings. The image forming apparatus according to the exemplary embodiment of the present invention is provided with a relay conveyance device as an option.

<Printer Apparatus>

A configuration of a printer apparatus (main body of the image forming apparatus) 100 according to a first exemplary embodiment will be described below with reference to FIG. 1.

Figure 1:
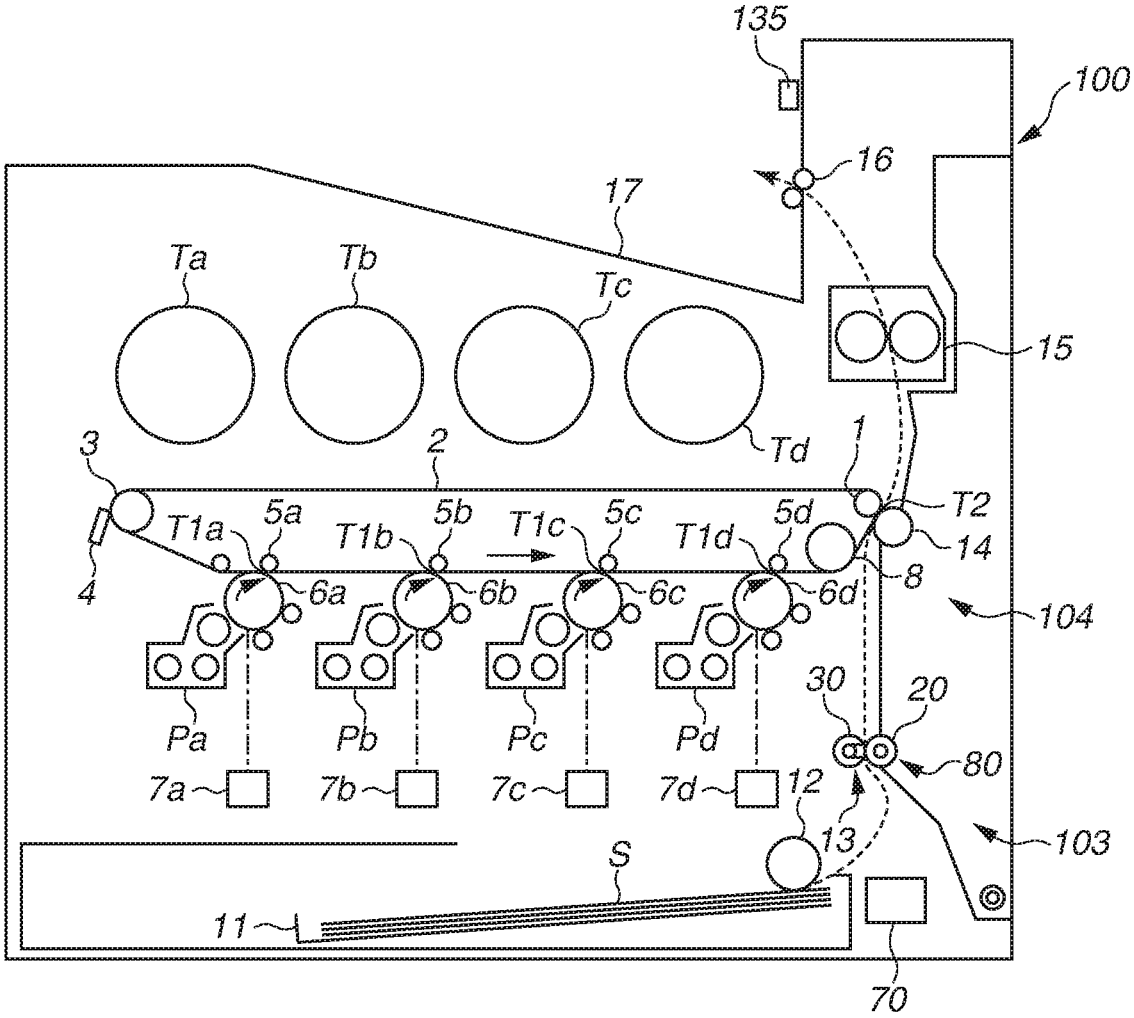
FIG. 1 is a sectional view illustrating printer apparatus according to an exemplary embodiment of the present invention.

FIG. 1 is a sectional view illustrating an overall configuration of the printer apparatus 100. As illustrated in FIG. 1, the printer apparatus 100 includes a feeding cassette 11 for storing a plurality of sheets S in a stacked state, and a sheet conveying portion 103 for conveying a sheet S from the feeding cassette 11. The printer apparatus 100 further includes an image forming portion 104 for forming an image on the sheet S conveyed by the sheet conveying portion 103, a discharge roller pair 16 for discharging the sheet S with an image formed thereon, and a sheet stacking face 17 on which the discharged sheet S is stacked. The discharge roller pair 16 is disposed at a position corresponding to a discharge port of the printer apparatus 100, and discharges the sheet S onto the sheet stacking face 17 via the discharge port. The space above the sheet stacking face 17 serves as a stacking portion on which discharged sheets are stacked. In the printer apparatus 100, a device such as an image reading unit is not disposed above the sheet stacking face 17, i.e., the space as a stacking portion. The upper part of the stacking portion is an open space.

The sheet conveying portion 103 includes a sheet feed roller 12 for feeding the sheet S while separating the sheets S stored in the feeding cassette 11 one by one through the friction separation method. The sheet conveying portion 103 includes a conveyance roller pair 13 formed by a first roller 30 and a second roller 20 for further conveying the fed sheet S. The sheet conveying portion 103 further includes a skew correction mechanism 80 for correcting the skew of the sheet S conveyed by the conveyance roller pair 13. The printer apparatus 100 includes a control unit 70 serving as a unit for controlling the entire sheet conveying portion 103 including the drive of the sheet feed roller 12 and the conveyance roller pair 13. The control unit 70 controls the entire printer apparatus 100 including not only the sheet conveying portion 103 but also the image forming portion 104.

The image forming portion 104 includes four process cartridges Pa to Pd for forming images of four colors (yellow (Y), magenta (M), cyan (C), and black (K)), and exposing devices 7*a* to 7*d* for emitting laser light based on image information. The process cartridges Pa to Pd include photosensitive drums 6*a* to 6*d*, respectively, on which electrostatic latent images are formed. The four process cartridges Pa to Pd have the same configuration except that the colors of images to be formed are different, and redundant descriptions of the process cartridge Pb to Pd will be omitted. The image forming portion 104 further includes an endless intermediate transfer belt 2 on which toner images on photosensitive drums 6*a* to 6*d* are primarily transferred, and primary transfer rollers 5*a* to 5*d* with which respective toner images on the photosensitive drums 6*a* to 6*d* are primarily transferred onto the intermediate transfer belt 2. The primary transfer rollers 5*a* to 5*d*, the photosensitive drums 6*a* to 6*d*, and the intermediate transfer belt 2 sandwiched therebetween form primary transfer portions T1*a* to T1*d*. In the primary transfer portions T1*a* to T1*d*, toner images of respective colors formed on the photosensitive drums 6*a* to 6*d* are transferred onto the intermediate transfer belt 2.

The image forming portion 104 further includes a secondary transfer roller 1 for stretching the intermediate transfer belt 2, a tension roller 3, a secondary transfer upstream roller 8, and a transfer cleaning unit 4 for cleaning the intermediate transfer belt 2. The image forming portion 104 further includes toner cartridges Ta to Td for supplying toner to the process cartridges Pa to Pd, respectively. The image forming portion 104 further includes a secondary transfer roller 14 for secondarily transferring the primarily transferred toner image onto the sheet S, and a fixing unit 15 for fixing the secondarily transferred toner image onto the sheet S with heat and pressure.

A print job (image forming operation) by the control unit 70 of the printer apparatus 100 having the above-described configuration will be described below. When a print job is started according to settings on an operation unit (not illustrated), the exposing devices 7*a* to 7*d* irradiate the photosensitive drums 6*a* to 6*d*, respectively, with laser light based on image information input from an external personal computer (PC). At this timing, since the photosensitive drums 6*a* to 6*d* are precharged to a negative potential, respective electrostatic latent images are formed on the photosensitive drums 6*a* to 6*d* when irradiated with laser light. The electrostatic latent images are reversely developed, and negatively charged toner is adhered. As a result, respective yellow (Y), magenta (M), cyan (C), and black. (K) toner images are formed on the photosensitive drums 6*a* to 6*d*.

In the primary transfer portions T1*a* to T1*d*, a positive primary transfer bias applied to the primary transfer rollers 5*a* to 5*d*, and pressure forces between the primary transfer rollers 5*a* to 5*d* and the intermediate transfer belt 2 are applied to the toner images of colors formed on the photosensitive drums 6*a* to 6*d*. Thus, in the primary transfer portions T1*a* to T1*d*, the toner images of respective colors formed on the photosensitive drums 6*a* to 6*d* are sequentially transferred from the photosensitive drums 6*a* to 6*d* onto the intermediate transfer belt 2 in a superposition way.

A 4-color toner image formed on the intermediate transfer belt 2 by transferring the toner images in a superposition way is conveyed to the secondary transfer roller 14 by the rotational drive of the intermediate transfer belt 2. In parallel with the above-described toner image forming operation, the sheets S stored in the feeding cassette 11 are separated and fed one by one by the sheet feed roller 12, and are conveyed by the conveyance roller pair 13 at a predetermined timing. While correcting the skew of the sheet S by using the skew correction mechanism 80, the conveyance roller pair 13 conveys the sheet S toward a secondary transfer portion T2 where the sheet S is nipped by the secondary transfer roller 14 and the intermediate transfer belt 2. A positive secondary transfer bias applied to the secondary transfer roller 14, and a pressure force between the secondary transfer roller 14 and the intermediate transfer belt 2 are applied to the sheet S conveyed to the secondary transfer portion T2. Thus, the 4-color toner image on the intermediate transfer belt 2 is secondarily transferred onto the sheet S.

The sheet S with the 4-color toner image transferred thereon is conveyed to the fixing unit 15, and then heated and pressurized by the fixing unit 15. Thus, the toner image is fixed. Then, the sheet S with the toner image fixed thereon is discharged onto the sheet stacking face 17 by the discharge roller pair 16.

<Optional Apparatus>

Figure 2:
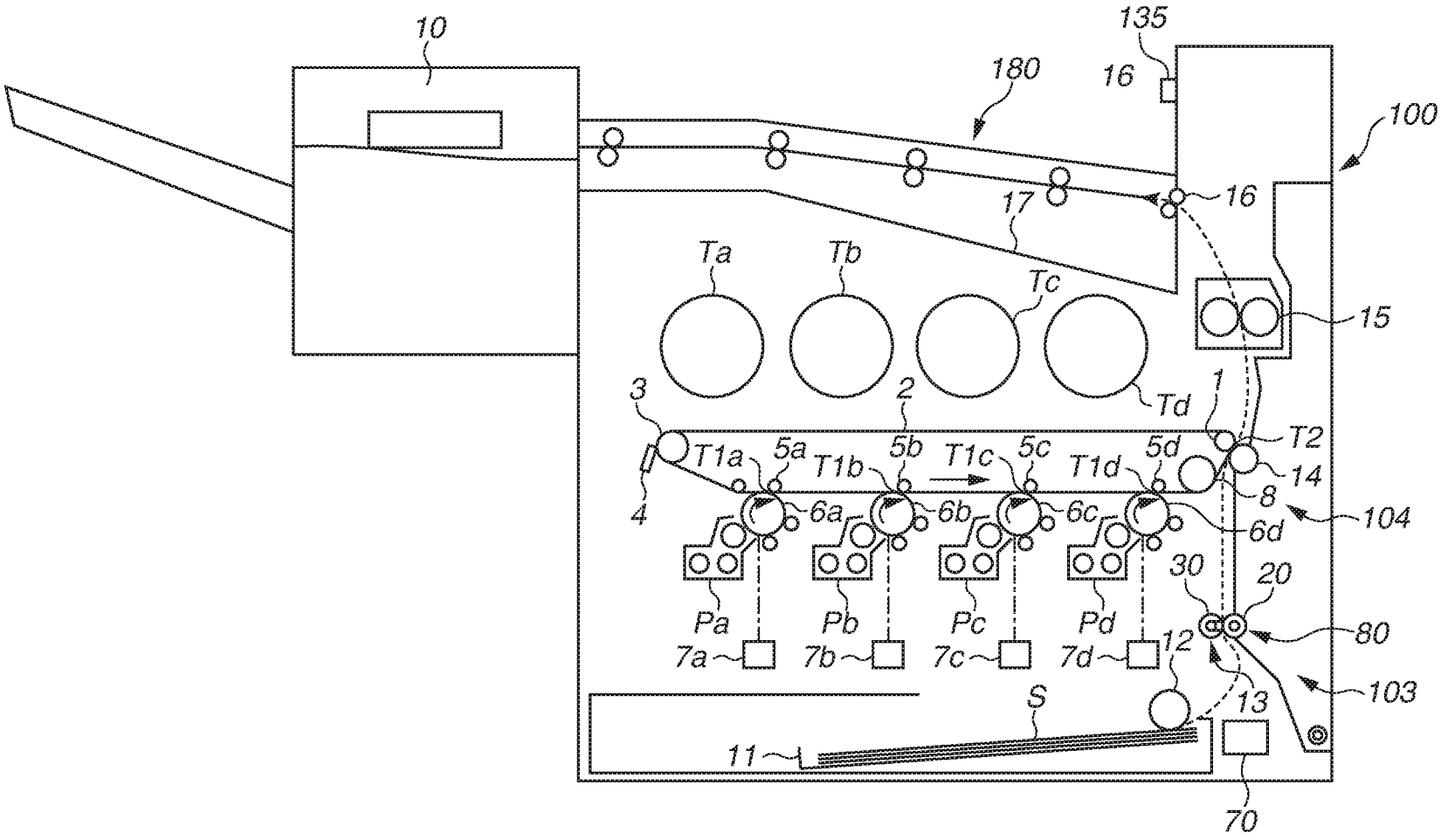
FIG. 2 is a sectional view illustrating the printer apparatus to which a relay conveyance device is attached.
Figure 3B:
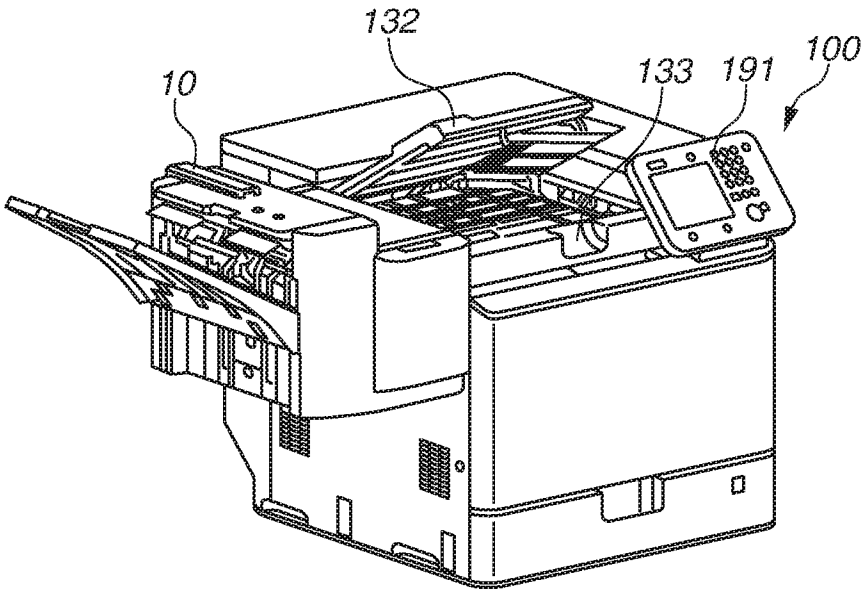
FIGS. 3A and 3B are perspective views illustrating the printer apparatus provided with the relay conveyance device.
Figure 3A:
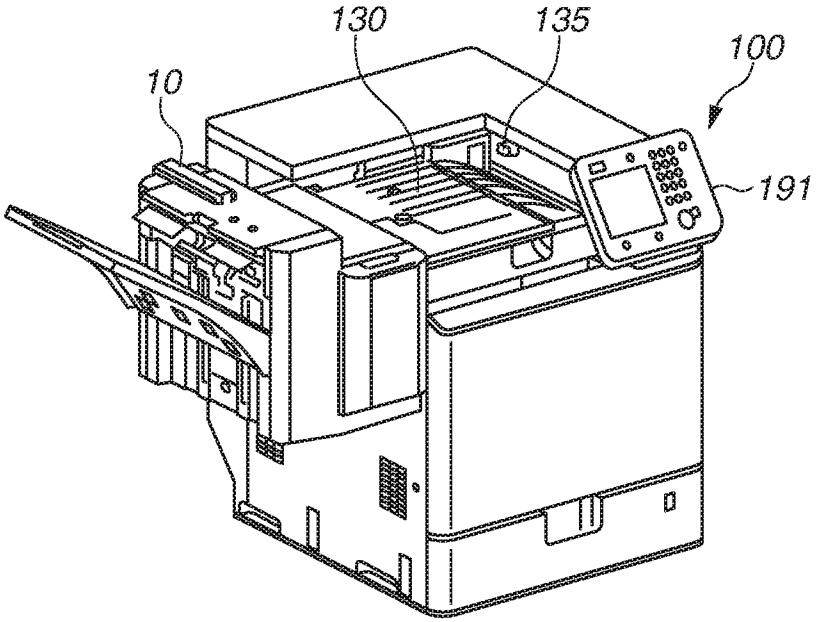
Figure 4:
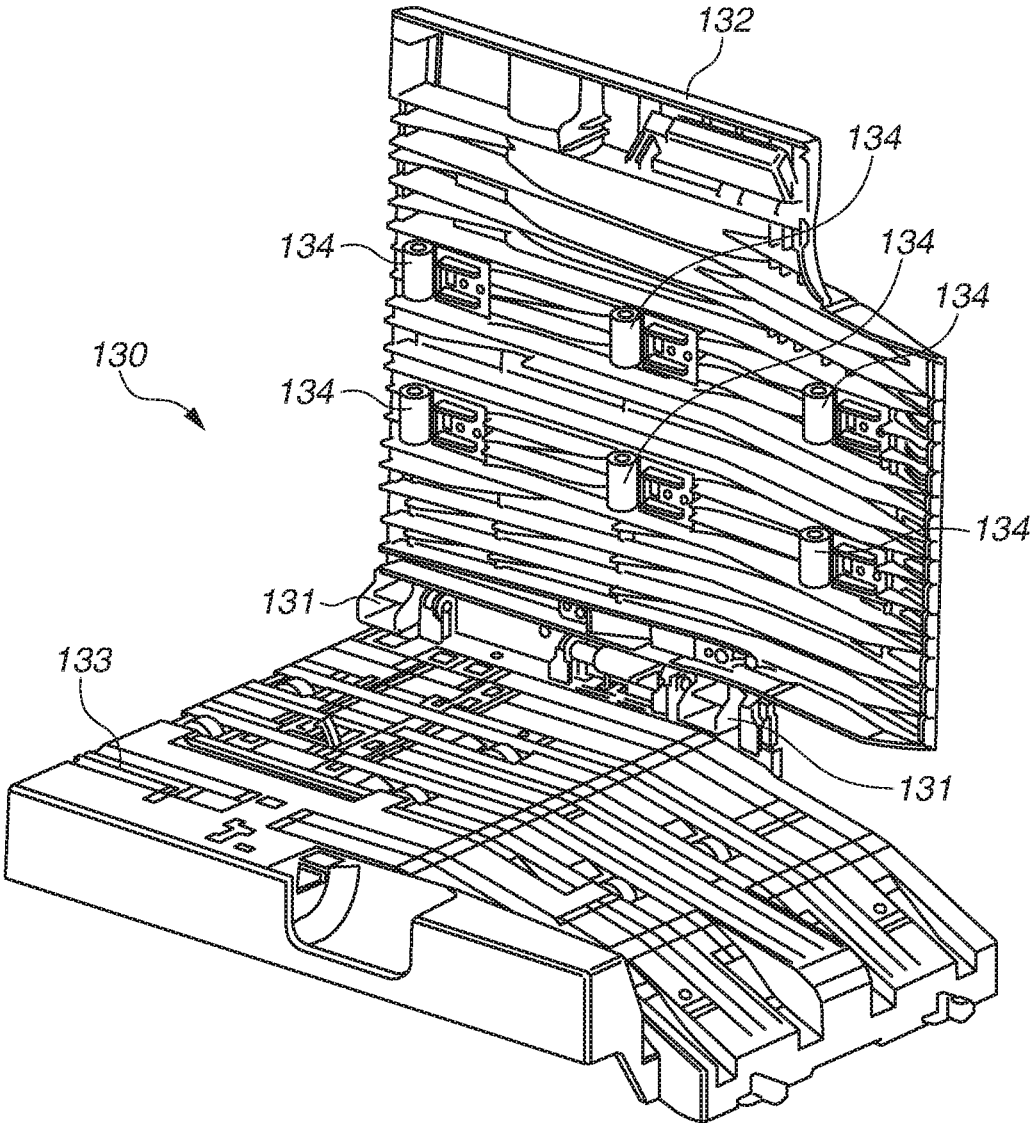
FIG. 4 is a perspective view illustrating the relay conveyance device.
Figure 5:
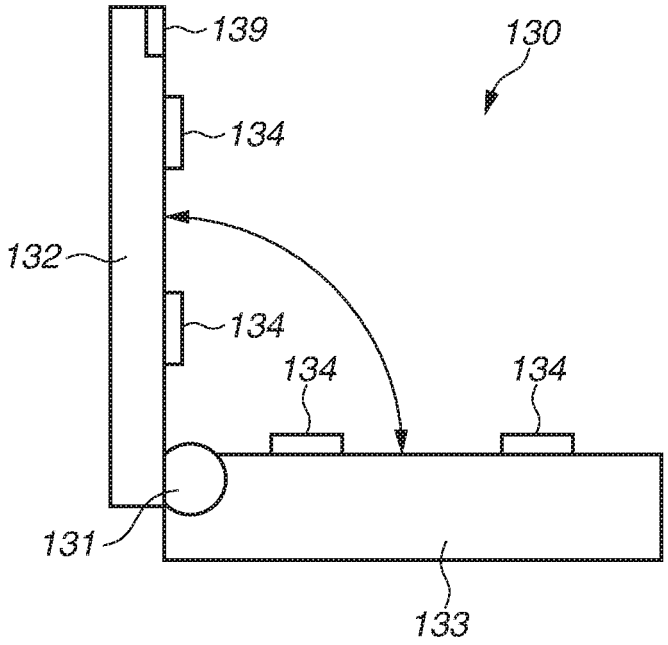
FIG. 5 is a schematic view illustrating a configuration of the relay conveyance device.

FIG. 2 is a sectional view illustrating the printer apparatus 100 in a state where a relay conveyance device 130 and a sheet post-processing apparatus 10 are attached to the printer apparatus 100. FIGS. 3A and 3B are perspective views illustrating the printer apparatus 100 in a state where the relay conveyance device 130 and the sheet post-processing apparatus 10 are attached. FIG. 4 is a perspective view illustrating a configuration of the relay conveyance device 130. FIG. 5 is a schematic view illustrating the configuration of the relay conveyance device 130.

As illustrated in FIG. 2, the relay conveyance device 130 is detachably attached as an optional apparatus to the stacking portion at the upper part (the space above the sheet stacking face 17) of the printer apparatus 100, on which the sheets S with an image formed thereon are stacked. The sheet post-processing apparatus 10 is attached to a side face of the printer apparatus 100 as an optional apparatus.

The relay conveyance device 130 is an apparatus for supplying a printed sheet received from the printer apparatus 100 to the sheet post-processing apparatus 10. The sheet post-processing apparatus 10 is an apparatus for performing post-processing such as binding processing on sheets.

As illustrated in FIG. 4, the relay conveyance device 130 includes a base unit 133 for forming a lower guide surface, and an upper guide unit (guide portion) 132 having an upper guide surface, rotatably attached to the base unit 133. The base unit 133 and the upper guide unit 132 are rotatably connected by a hinge connecting portion including a rotational axis 131. The rotational axis 131 is disposed on the rear side of the relay conveyance device 130. The rotational axis 131 extends in the horizontal direction, i.e., in the sheet conveyance direction.

If a sheet jam occurs inside the relay conveyance device 130, it is necessary to open the upper guide unit 132 of the relay conveyance device 130 to process the jammed sheet. As illustrated in FIG. 4, the front side of the upper guide unit 132 can be opened centering on the rotational axis 131 on the rear side when viewed from the front face of the relay conveyance device 130. The front face of the relay conveyance device 130 is the side where a user who operates an operation unit 191 (see FIGS. 3A and 3B) of the printer apparatus 100 stands.

More specifically, the conveyance path of the relay conveyance device 130 can be opened by rotating the upper guide unit 132 centering on the rotational axis 131. When the upper guide unit 132 is opened, the sheet S is separated from the upper rollers 134 of the upper guide unit 132 and lower rollers of the base unit 133. When the sheet S nipped and stopped by the conveyance rollers is released, the sheet S becomes processable.

When the conveyance rollers are to be replaced for maintenance, the relay conveyance device 130 is removed from the printer apparatus 100. When the relay conveyance device 130 is removed from the printer apparatus 100, the upper guide unit 132 can be largely opened, as illustrated in FIG. 4, because the relay conveyance device 130 has no member for restricting the rotation of the upper guide unit 132. When replacing the upper rollers 134 on the upper guide unit 132 or the lower rollers on the base unit 133 for maintenance, a large opening angle of the upper guide unit 132 (the angle formed by the upper guide unit 132 and the base unit 133) facilitates maintenance work.

On the other hand, the user needs to open the upper guide unit 132 even in a state where the relay conveyance device 130 is attached as an option to the stacking portion (the space above the sheet stacking face 17) of the printer apparatus 100, as illustrated in FIGS. 3A and 3B. More specifically, if a sheet jam occurs in the relay conveyance device 130, the user opens the upper guide unit 132 including the upper sheet guide of the relay conveyance device to process the jammed sheet, as illustrated in FIG. 3B.

When the relay conveyance device 130 is attached to the printer apparatus 100, as illustrated in FIG. 3, the operability is degraded if the upper guide unit 132 can be largely opened as in the stand-alone state where the relay conveyance device 130 is not attached to the printer apparatus 100. In the present exemplary embodiment, therefore, the following measures are taken so that the upper guide unit 132 may not be largely opened. When the upper guide unit 132 is largely opened, the operability in closing the upper guide unit 132 is degraded particularly for a short user and a user on a wheelchair.

The following describes a configuration for restricting the rotation of the upper guide unit 132 of the relay conveyance device 130, and opening and closing operations of the upper guide unit 132 during jammed sheet processing.

Figure 6:
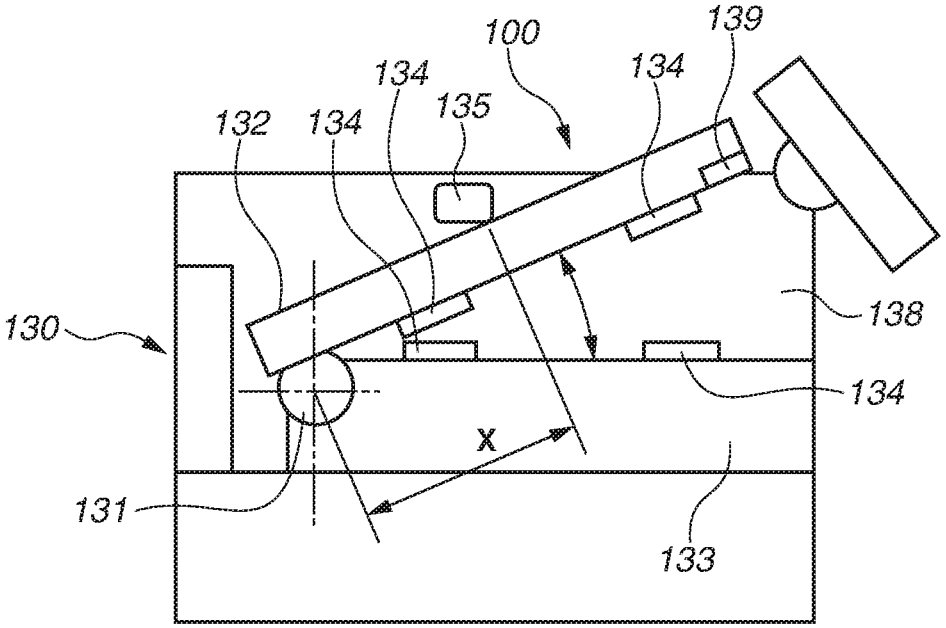
FIG. 6 illustrates operations of the relay conveyance device when attached to the printer apparatus.
Figure 7:
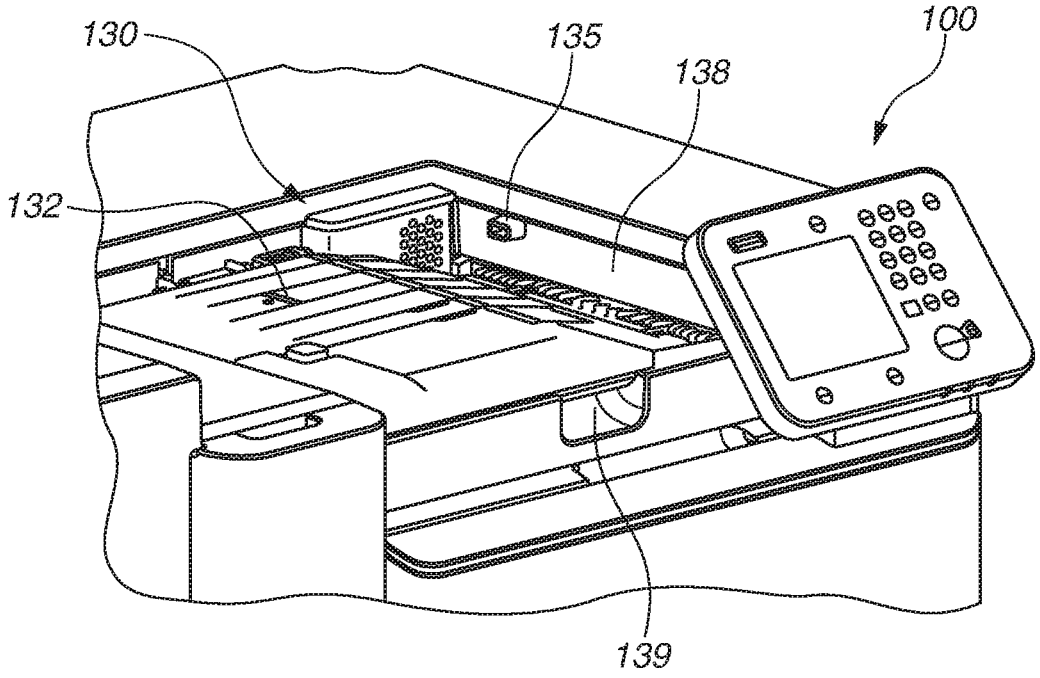
FIG. 7 is a perspective view illustrating the printer apparatus provided with the relay conveyance device.
Figure 8:
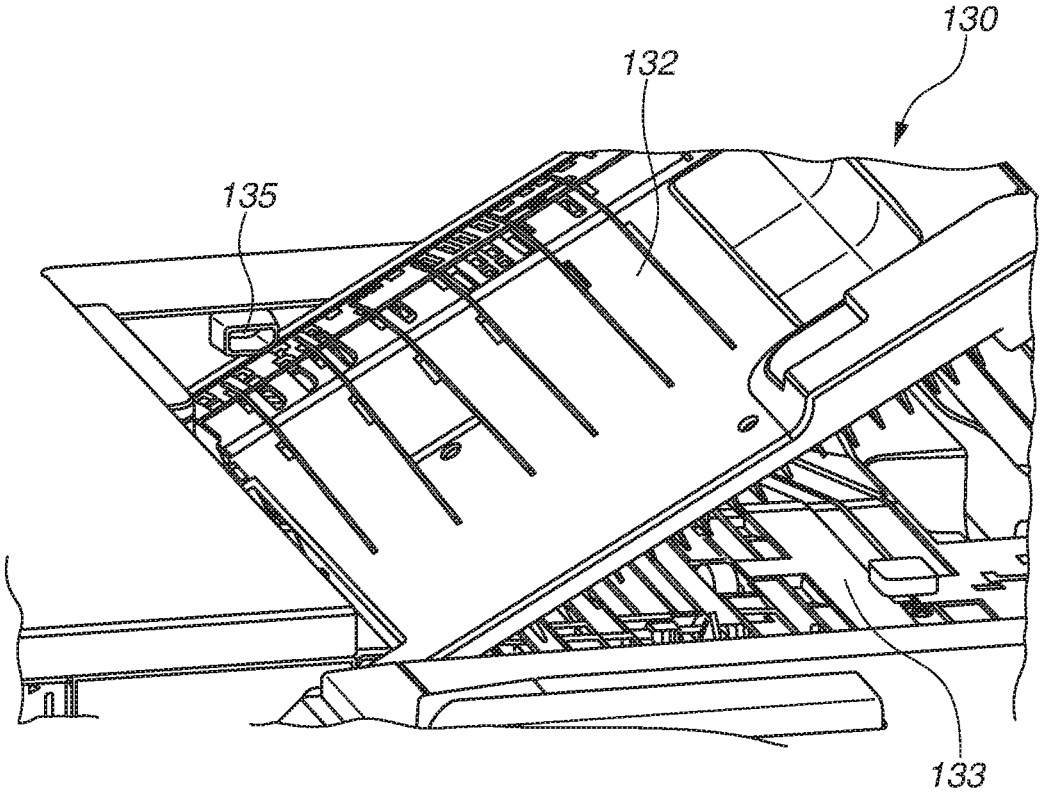
FIG. 8 is a perspective view illustrating the printer apparatus provided with the relay conveyance device.

FIG. 6 is a simple cross sectional view illustrating the printer apparatus 100 provided with the relay conveyance device 130. FIGS. 7 and 8 are perspective views illustrating the printer apparatus 100 provided with the relay conveyance device 130.

As illustrated in FIGS. 6, 7, and 8, the restricting member 135 as a restriction portion for restricting the rotation of the upper guide unit 132 is protruded in the horizontal direction (sheet discharge direction) from a vertical wall 138 in the printer apparatus 100. The vertical wall 138 is a vertically extending wall portion facing the stacking portion (more specifically, an attaching portion to which the relay conveyance device 130 is attached), i.e., the space above the sheet stacking face 17 of the printer apparatus 100.

Figure 9:
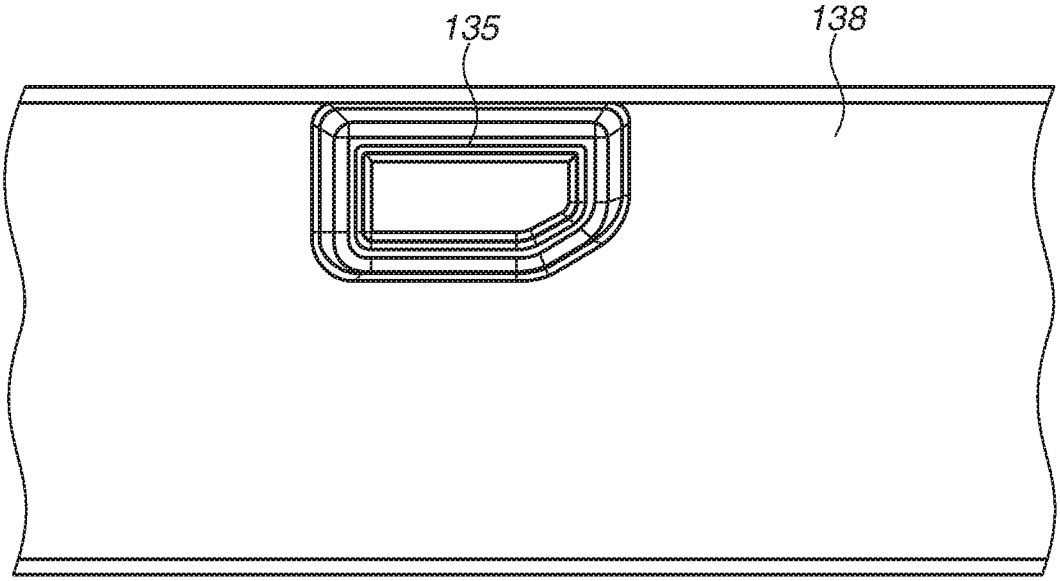
FIG. 9 illustrates a restricting member.

The vertical wall 138 is provided with a discharge port at the position corresponding to the discharge roller pair 16. The discharge roller pair 16 discharges the sheet S to the outside of the printer apparatus 100 via the discharge port. The restricting member 135 is protruded from a position above the discharge port on the vertical wall 138. The restricting member 135 is a projection integrally formed with the vertical wall 138 serving as an exterior cover (see FIG. 9).

If a paper jam occurs in the relay conveyance device 130, the user raises a handle 139 illustrated in FIG. 7 to open the upper guide unit 132. Then, as illustrated in FIG. 8, when the user opens the upper guide unit 132 of the relay conveyance device 130, an edge portion of the upper guide unit 132 on the upstream side in the sheet conveyance direction abuts to the restricting member 135. When the upper guide unit 132 abuts to the restricting member 135, the movement of the upper guide unit 132 is restricted so as not to move exceeding a predetermined opening angle (hereafter referred to as an opening angle).

More specifically, in a state where the relay conveyance device 130 is attached to the printer apparatus 100, the upward movement of the upper guide unit 132 is restricted by the restricting member 135, as illustrated in FIGS. 6 and 8. The position where the restricting member 135 restricts the rotation of the upper guide unit 132 is set to a position where the operability in the jammed sheet processing is favorable.

The opening angle of the upper guide unit 132 may be such an angle with which the upper rollers 134 on the upper guide unit 132 and the lower rollers on the base unit 133 are separated and the hand of the user can access the jammed sheet. When performing the closing operation of the upper guide unit 132, it is desirable that the opening/closing angle between the upper guide unit 132 and the base unit 133 is small. This is because, when the upper guide unit 132 is largely opened, the operability in closing the upper guide unit 132 is degraded particularly for a short user and a user on a wheelchair.

Therefore, to provide both of the maintainability and the jammed sheet processing workability of the relay conveyance device 130, it is desirable to take the following measures.

More specifically, in the stand-alone state where the relay conveyance device 130 is not attached to the printer apparatus 100, the opening/closing angle between the upper guide unit 132 and the base unit 133 is made as large as possible. In a state where the relay conveyance device 130 is attached to the printer apparatus 100, the restricting member 135 for restricting the movement of the upper guide unit 132 is provided in the printer apparatus 100, as illustrated in FIGS. 6 and 8, so that favorable workability is provided in the jammed sheet processing. This enables providing both of the maintainability and the jammed sheet processing workability of the relay conveyance device 130.

The provision of the restricting member 135 not in the relay conveyance device 130 but in the printer apparatus 100 will be described in more detail below. If a sheet jam occurs within the relay conveyance device 130, the user opens the upper guide unit 132 first and then performs jammed sheet processing. In this case, the opening/closing angle of the upper guide unit 132 is restricted by the restricting member 135. It is necessary to take measures for preventing the restricting member 135 from being distorted or damaged even if the user applies a physical force beyond assumption.

The user rotates the upper guide unit 132 by holding the handle 139 most away from the rotational axis 131 centering on the rotational axis 131. The rotation moment at this moment affects the restricting member 135. To minimize the load for raising the handle 139, it is desirable to provide a long distance X from the rotational axis 131 to the restricting member 135 (see FIG. 6). Therefore, it is desirable that the restricting member 135 is disposed at a position away from the rotational axis 131 of the relay conveyance device 130.

A designer is burdened with a condition that the restricting member for restricting the upper guide unit 132 is desirably separated from the rotational axis 131 of the relay conveyance device 130. Under this condition, providing the restricting member 135 for restricting the rotation of the upper guide unit 132, on the printer apparatus 100 ensures design flexibility. For example, to provide the restricting member 135 on the relay conveyance device 130, it is necessary to increase the size of the relay conveyance device 130 to ensure a position for disposing the restricting member 135.

In the above-described exemplary embodiment, the restricting member 135 is a projection integrally formed with the vertical wall 138 serving as an exterior cover. However, like the modification illustrated in FIG. 10, the position of the restricting member 135 may be made adjustable. The printer apparatus 100 is assumed to be used in various workplace environments of the user. In particular, with different installation positions of the printer apparatus 100 in the height direction, the user's eye line changes. Therefore, even with the optimally set opening/closing angle between the upper guide unit 132 and the base unit 133, a difference may arise in the jammed sheet processing workability.

Figure 10:
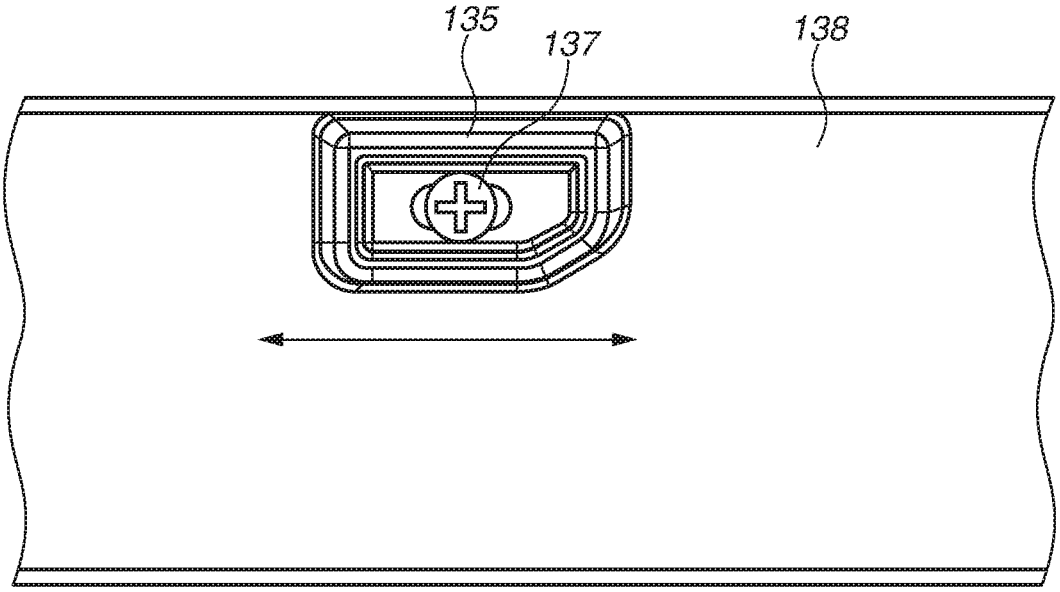
FIG. 10 illustrates a modification of the restricting member.

In the modification illustrated in FIG. 10, the restricting member 135 is made of a different material from that of the vertical wall 138. More specifically, the restricting member 135 can be attached onto the vertical wall 138 with a screw and is movable in the directions indicated by the arrows. Changing the position of the restricting member 135 enables adjusting the opening/closing angle of the upper guide unit 132.

Figure 11B:
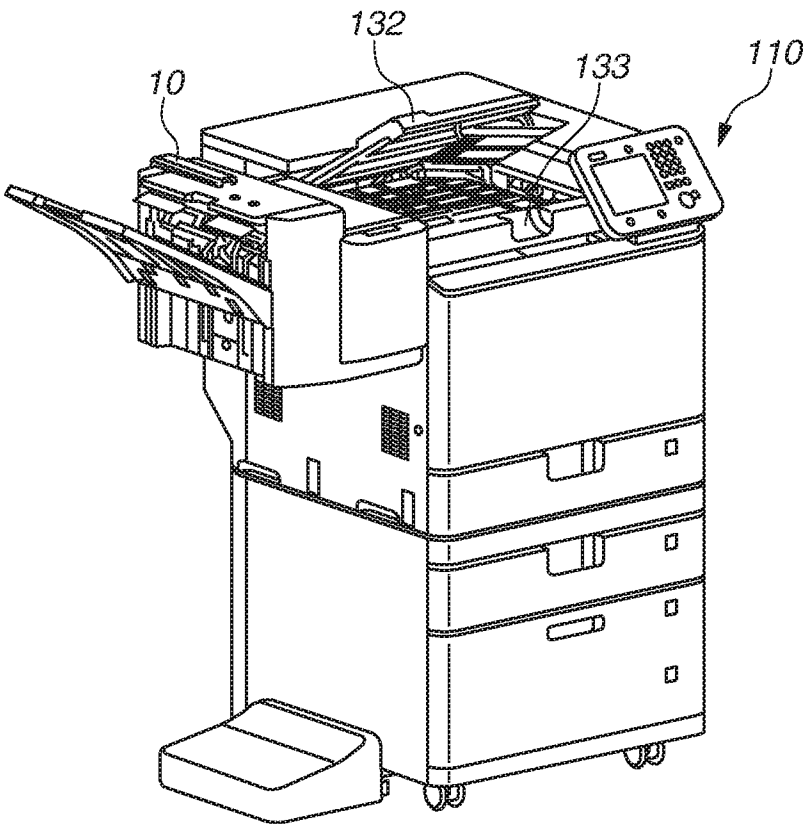
FIGS. 11A and 11B illustrate a state where the relay conveyance device is attached to another printer apparatus (second printer apparatus).
Figure 11A:
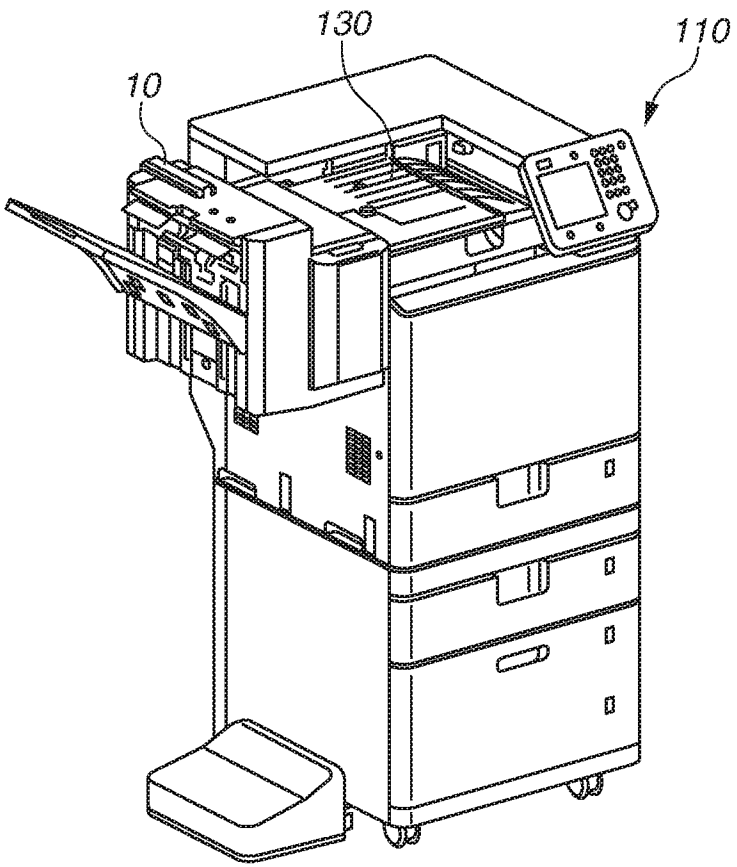

The relay conveyance device 130 can be attached to printer apparatuses of other types. FIGS. 11A and 11B illustrate a state where the relay conveyance device 130 is attached to a second printer apparatus 110. Since the second printer apparatus 110 is not provided with an image reading unit, the upper part of the relay conveyance device 130 is an open space. A restricting member for restricting the movement of the upper guide unit 132 is also provided on the second printer apparatus 110. Since the second printer apparatus 110 is large in height, the restricting member is disposed so that opening angle of the upper guide unit 132 becomes smaller than that of the printer apparatus 100 of the type described above with reference to FIG. 1.

Figure 12B:
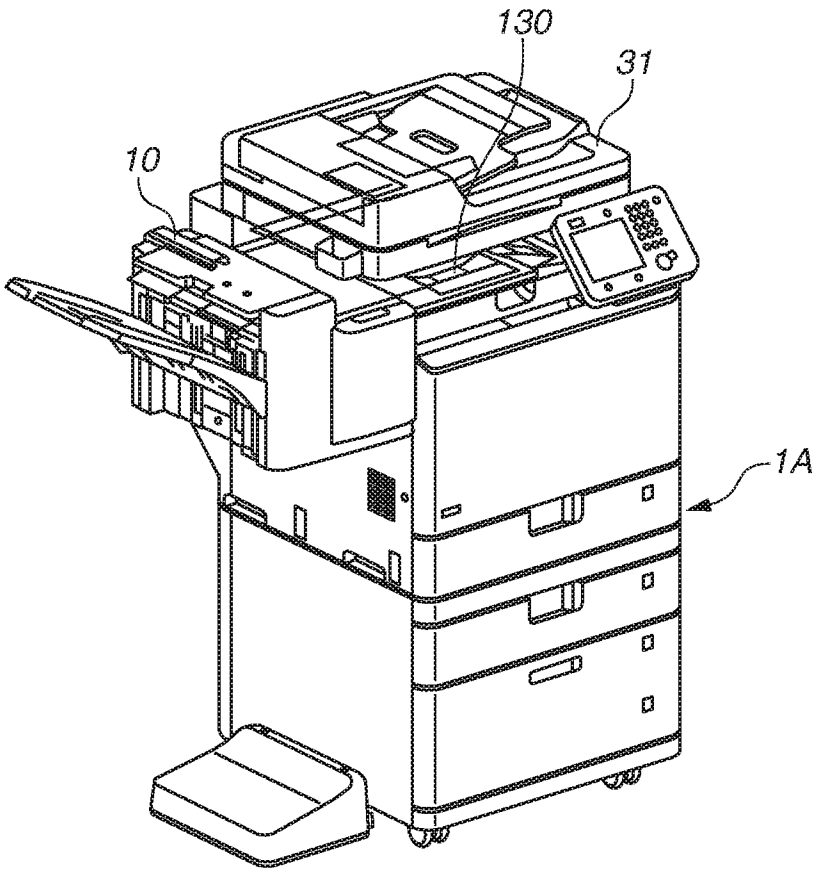
FIGS. 12A and 12B illustrate a state where the relay conveyance device is attached to another printer apparatus (third printer apparatus).
Figure 12A:
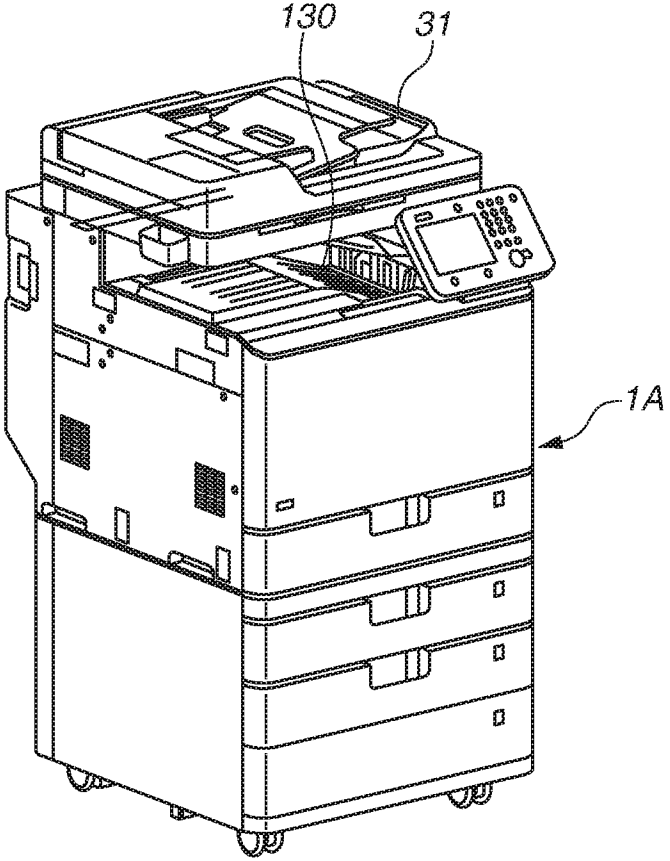

The relay conveyance device 130 can also be attached to a third printer apparatus 1A having an image reading unit 31 disposed at the upper part, as a printer apparatus of another type (see FIGS. 12A and 12B). The third printer apparatus 1A is provided with the image reading unit 31 for reading a document image above the stacking portion on which a sheet with an image formed thereon is discharged and stacked.

Although the relay conveyance device 130 is attached to the stacking portion, in the third printer apparatus 1A, the relay conveyance device 130 is disposed below the image reading unit 31, as illustrated in FIG. 12B. In this case, the rotation of the upper guide unit 132 of the relay conveyance device 130 is restricted by the undersurface of the image reading unit 31. More specifically, during jammed sheet processing (jam processing), when the opening operation of the upper guide unit 132 is performed, the upper guide unit 132 opens until it abuts to the undersurface of the image reading unit 31. Even with a printer apparatus having the image reading unit 31 disposed above the relay conveyance device 130 like the third printer apparatus 1A, the movement of the upper guide unit 132 may be restricted by a restriction portion protruded from the wall portion in which a discharge port is disposed. For example, in a case where the image reading unit 31 is disposed at a high position and separated from the relay conveyance device 130, the movement of the upper guide unit 132 may be restricted by the restriction portion protruded from the vertically extending wall portion in which the discharge port is disposed, as illustrated in FIG. 1.

Figure 13:
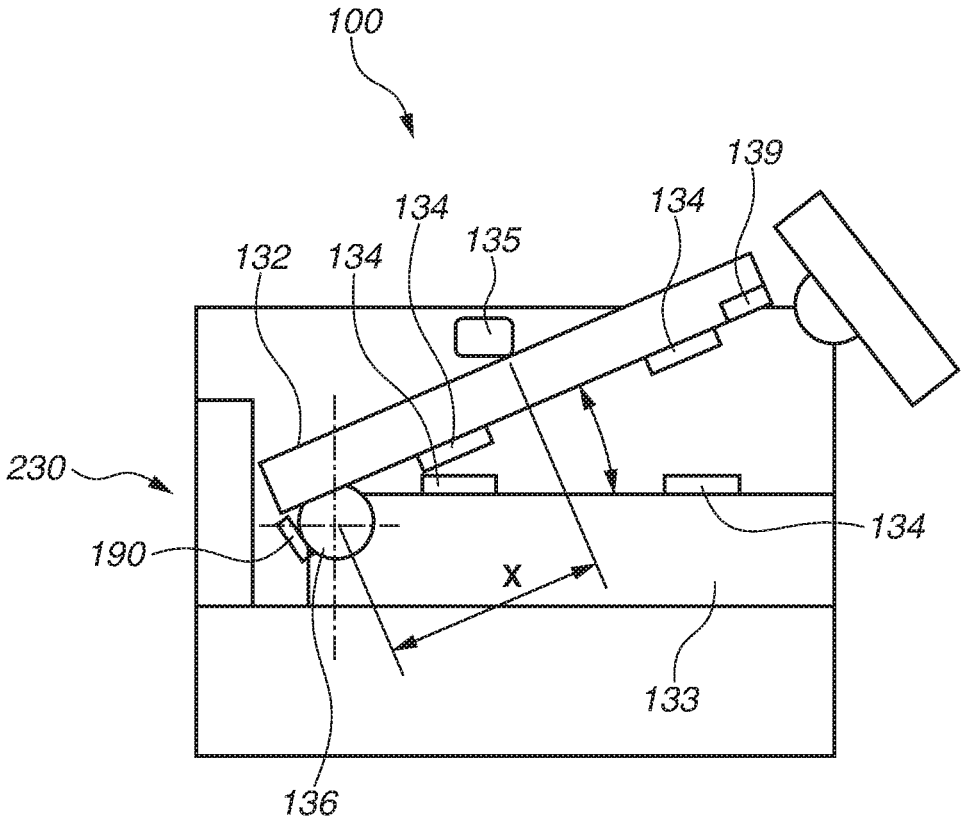
FIG. 13 illustrates a modification of the relay conveyance device.

In the above-described examples, the restricting member for restricting the rotation of the upper guide unit 132 of the relay conveyance device 130 is disposed only on the printer apparatus. However, in addition to the restricting member on the printer apparatus, another stopper for restricting the rotation of the upper guide unit 132 may be auxiliary provided also in the relay conveyance device 130. FIG. 13 illustrates a modification (a relay conveyance device 230) provided with a stopper 190 for restricting the rotation of the upper guide unit 132.

In the modification illustrated in FIG. 13, when the upper guide unit 132 is opened, the rotation of the upper guide unit 132 is restricted by the restricting member 135 provided in the printer apparatus 100. An operation for opening the upper guide unit 132 is performed by the user. Therefore, if the user applies a large physical force to the upper guide unit 132, the upper guide unit 132 may possibly be damaged. In the present exemplary embodiment, the restricting member 135 contacts one edge portion of the upper guide unit 132 in the direction of the axis line of the rotational axis 131, and the handle 139 of the upper guide unit 132 is disposed at the center of the rotational axis 131, which causes the upper guide unit 132 to be easily damaged. To prevent damage, the relay conveyance device 230 is provided with the stopper 190 that is able to contact the other edge portion on the side opposite to the one edge portion of the upper guide unit 132 contacting the restricting member 135 in the direction of the axis line of the rotational axis 131. The stopper 190 is disposed so that, when the upper guide unit 132 being upward moved is changed in shape by an additional upward physical force received after contacting the restricting member 135, the stopper 190 starts contacting the upper guide unit 132 to restrict its position. More specifically, the upper guide unit 132 is intended to contact the restricting member 135 first. Since the rotation of the upper guide unit 132 is restricted at both edge portions thereof in the direction of the axis line of the rotational axis 131, the upper guide unit 132 is hardly damaged even if it receives an excessive physical force.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-118575, filed Jun. 11, 2015, which is hereby incorporated by reference herein in its entirety.

What is claimed is:

1. An image forming apparatus comprising:

a main body configured to form an image on a sheet, and provided with a storing space in which stacked sheets with an image formed thereon are to be stored;

a sheet conveyance device detachably attached to the storing space, and provided with a conveyance path for conveying a sheet, wherein the sheet conveyance device includes a base portion and a guide portion configured to form the conveyance path at a closed position so as to guide the conveyed sheet, wherein the guide portion is rotatably supported by the base portion about a rotational axis so that the guide portion is able to be rotated with respect to the base portion in a first rotating direction from the closed position, and wherein, in a case that the guide portion rotates in the first rotating direction from the closed position, the conveyance path is opened;

a wall portion vertically extending and disposed in the main body, wherein the wall portion faces the storing space; and a protrusion protruded from the wall portion, wherein the guide portion that is being rotated in the first rotating direction comes into contact with the protrusion to stop rotating with respect to the base portion in the first rotating direction, and the guide portion that is in contact with the protrusion is unable to rotate any further in the first rotating direction beyond a predetermined position.

2. The image forming apparatus according to claim 1, wherein the wall portion is provided with a discharge port through which a sheet is to be discharged from the main body.

3. The image forming apparatus according to claim 2, wherein the protrusion is horizontally protruded from a position above the discharge port on the wall portion.

4. The image forming apparatus according to claim 1, wherein the conveyance path is configured to guide a sheet being horizontally conveyed, and wherein the protrusion is configured to restrict an upward movement of the guide portion for opening the conveyance path.

5. The image forming apparatus according to claim 1, wherein the rotational axis extends horizontally, and wherein, for an upper portion of the guide portion to be contacted with the protrusion, the upper portion is arranged in neighborhood of an edge of guide portion in a direction of an axis line of the rotational axis.

6. The image forming apparatus according to claim 5, wherein the rotational axis extends in a sheet conveyance direction.

7. The image forming apparatus according to claim 1, wherein the protrusion is position-adjustably attached to the main body.

8. The image forming apparatus according to claim 1, wherein the sheet conveyance device is provided with a stopper disposed so as to contact the guide portion changed in shape by an additional physical force received after contacting the protrusion.

9. The image forming apparatus according to claim 1, further comprising a sheet post-processing apparatus configured to perform post-processing on a sheet conveyed by the sheet conveyance device.

10. The image forming apparatus according to claim 1, wherein the protrusion stops the rotation of the guide portion with respect to the base portion in the first rotating direction such that the rotation of the guide portion with respect to the base portion does not exceed a predetermined position in the first rotating direction.

11. The image forming apparatus according to claim 1, wherein a portion of the guide portion to contact with the protrusion is disposed in a neighborhood of the wall portion.

12. An image forming apparatus comprising:

a main body configured to form an image on a sheet, and provided with a storing space in which stacked sheets with an image formed thereon are stored;

a sheet conveyance device detachably attached to the storing space, and provided with a conveyance path where the sheet with an image formed thereon by the main body is to be conveyed, wherein the sheet conveyance device includes a base portion, and wherein the image forming apparatus is provided with an open space above the sheet conveyance device in a state in which the sheet conveyance device is attached to the storing space;

a guide portion configured to form the conveyance path at a closed position so as to guide the conveyed sheet, wherein the guide portion is rotatably supported by the base portion about a rotational axis so that the guide portion is able to be rotated with respect to the base portion in a first rotating direction from the closed position, and wherein, in a case that the guide portion rotates in the first rotating direction from the closed position, the conveyance path is opened; and a protrusion protruded from the wall portion, wherein the guide portion that is being rotated in the first rotating direction comes into contact with the protrusion to stop rotating with respect to the base portion in the first rotating direction, and the guide portion that is in contact with the protrusion is unable to rotate any further in the first rotating direction beyond a predetermined position.

13. The image forming apparatus according to claim 12, further comprising a wall portion vertically extending and disposed in the main body, wherein the wall portion faces the storing space, and wherein the protrusion is disposed so as to protrude from the wall portion.

14. The image forming apparatus according to claim 13, wherein the wall portion is provided with a discharge port through which a sheet is to be discharged from the main body.

15. The image forming apparatus according to claim 14, wherein the protrusion is horizontally protruded from a position above the discharge port on the wall portion.

16. The image forming apparatus according to claim 12, wherein the conveyance path is configured to guide a sheet being horizontally conveyed, and wherein the protrusion is configured to restrict an upward movement of the guide portion for opening the conveyance path.

17. The image forming apparatus according to claim 12, wherein the rotational axis extends horizontally, and wherein, for an upper portion of the guide portion to be contacted with the protrusion, the upper portion is arranged in neighborhood of an edge of guide portion in a direction of an axis line of the rotational axis.

18. The image forming apparatus according to claim 17, wherein the rotational axis extends in a sheet conveyance direction.

19. The image forming apparatus according to claim 12, wherein the protrusion is position-adjustably attached to the main body.

20. The image forming apparatus according to claim 12, wherein the sheet conveyance device is provided with a stopper disposed so as to contact the guide portion changed in shape by an additional physical force received after contacting the protrusion.

21. The image forming apparatus according to claim 12, further comprising a sheet post-processing apparatus configured to perform post-processing on a sheet conveyed by the sheet conveyance device.

22. The image forming apparatus according to claim 12, wherein the protrusion stops the rotation of the guide portion with respect to the base portion in the first rotating direction such that the rotation of the guide portion with respect to the base portion does not exceed a predetermined position in the first rotating direction.

* * * * *